US009392831B2

(12) United States Patent
Storelli et al.

(10) Patent No.: US 9,392,831 B2
(45) Date of Patent: Jul. 19, 2016

(54) PROTECTIVE HEAD GUARD

(71) Applicant: STORELLI SPORTS LLC, Brooklyn, NY (US)

(72) Inventors: Claudio Storelli, New York, NY (US); Jing Liang, Brooklyn, NY (US); Thomas Vincent Marchesi, Brooklyn, NY (US); Matthew Weill, New York, NY (US)

(73) Assignee: STORELLI SPORTS, INC., Brooklyn, NY (US)

( * ) Notice: Subject to any disclaimer, the term of this patent is extended or adjusted under 35 U.S.C. 154(b) by 166 days.

(21) Appl. No.: 14/260,935

(22) Filed: Apr. 24, 2014

(65) Prior Publication Data

US 2014/0331391 A1 Nov. 13, 2014

Related U.S. Application Data

(60) Provisional application No. 61/821,507, filed on May 9, 2013.

(51) Int. Cl.

| | |
|---|---|
| ***A42B 1/08*** | (2006.01) |
| ***A42B 3/12*** | (2006.01) |
| ***A42B 3/00*** | (2006.01) |
| ***A42B 3/06*** | (2006.01) |

(52) U.S. Cl.
CPC ... *A42B 3/00* (2013.01); *A42B 1/08* (2013.01); *A42B 3/069* (2013.01)

(58) Field of Classification Search
CPC ..... A42B 3/00; A42B 3/105; A42B 3/069; A42B 3/125; A42B 3/128; A42B 1/08; A42B 3/12; A63B 71/10
USPC ..... 2/411, 412, 425, 413, 414, 415; 602/17, 602/18
See application file for complete search history.

(56) References Cited

U.S. PATENT DOCUMENTS

| | | | | |
|---|---|---|---|---|
| 3,087,166 | A * | 4/1963 | Howard | A42B 3/00 2/420 |
| 3,171,133 | A * | 3/1965 | Steffen | A42B 3/00 2/414 |
| 4,317,239 | A * | 3/1982 | Bryksa | A61F 13/12 2/411 |
| 4,646,367 | A * | 3/1987 | El Hassen | A42B 3/00 2/171 |
| 5,930,841 | A | 8/1999 | Lampe | |
| 5,946,734 | A * | 9/1999 | Vogan | A42B 3/00 2/171 |
| 6,266,827 | B1 | 7/2001 | Lampe | |
| 6,272,692 | B1 | 8/2001 | Abraham | |
| 6,282,724 | B1 | 9/2001 | Abraham | |
| 6,349,416 | B1 | 2/2002 | Lampe | |
| 6,378,140 | B1 | 4/2002 | Abraham | |
| 6,381,760 | B1 | 5/2002 | Lampe | |
| 6,397,399 | B1 | 6/2002 | Lampe | |

(Continued)

*Primary Examiner* — Amy Vanatta
(74) *Attorney, Agent, or Firm* — Gottlieb, Rackman & Reisman, PC

(57) ABSTRACT

A non-rigid head guard assembly that provides protection against head collisions. The head guard is circular with a narrower section at the forehead and a wider section at the rear to protect the back of the head. The head guard, at the sections in contact with the temple area of the head and the back of the head, is reinforced with an additional layer of foam. The exterior of the assembly is made of breathable and moisture wicking fabric. The interior protective element consists of either a single layer of viscoelastic polyurethane foam or a dual layer viscoelastic polyurethane foam separated by a thin layer of semi-dry lubricant, which is a low friction material, for enhanced wear and corrosion protection.

20 Claims, 4 Drawing Sheets

(56) References Cited

U.S. PATENT DOCUMENTS

| | | | | |
|---|---|---|---|---|
| 6,428,494 | B1 * | 8/2002 | Schwenn | A61F 5/05891 2/414 |
| 6,625,820 | B1 | 9/2003 | Lampe | |
| 6,675,395 | B1 | 1/2004 | Abraham | |
| 6,939,316 | B2 * | 9/2005 | Sklar | A61F 5/05891 128/857 |
| 6,978,487 | B2 | 12/2005 | Abraham | |
| 7,188,375 | B2 * | 3/2007 | Harrington | A42B 3/324 2/183 |
| 7,234,174 | B2 | 6/2007 | Abraham | |
| 7,926,119 | B2 * | 4/2011 | Monk | A61F 5/0109 2/24 |
| 8,042,198 | B1 | 10/2011 | Cleveland | |
| 8,214,928 | B1 | 7/2012 | Cleveland | |
| 2005/0193477 | A1 * | 9/2005 | Penny | A63B 71/10 2/411 |
| 2005/0204456 | A1 | 9/2005 | Piper et al. | |
| 2007/0079418 | A1 * | 4/2007 | Fehervizy | A42B 3/00 2/8.3 |
| 2008/0172779 | A1 * | 7/2008 | Ferguson | A41D 31/005 2/455 |
| 2010/0101006 | A1 | 4/2010 | Cleveland | |
| 2014/0237703 | A1 * | 8/2014 | Tateo | A42B 3/00 2/181 |
| 2015/0040296 | A1 * | 2/2015 | Hanson | A42B 3/069 2/411 |

* cited by examiner

PROTECTIVE HEAD GUARD

CROSS-REFERENCE TO RELATED APPLICATIONS

This application claims the priority under 35 U.S.C. §119 to U.S. Provisional Application No. 61/821,507, entitled "Protective Head Guard," filed May 9, 2013, which is hereby incorporated by reference in its entirety as part of the present disclosure.

FIELD OF THE INVENTION

The present invention relates generally to athletic protective gear and more specifically, to a protective head guard made of non-rigid material, for use in sports such as soccer, rugby, handball, lacrosse, skiing, snowboarding, figure skating, roller hockey, ice hockey, field hockey, and other sports where a non-hard shell protective headgear would be beneficial.

BACKGROUND OF THE INVENTION

Head injuries from contact sports widely recognized as a serious health issue. High-impact collisions can sometimes result in concussions, which the Centers for Disease Control and Prevention defines as a "type of Traumatic Brain Injury (TBI) caused by a bump, blow, or jolt to the head that can change the way your brain normally works." There is a growing body of scientific and clinical evidence linking concussions and long-term impairment of cognitive functions. Repeat concussions are linked to Chronic Traumatic Encephalopathy (CTE), a progressive neurodegenerative disease that has Alzheimer-like symptoms. In a 2012 study, autopsy of 85 deceased brain donors who suffered multiple brain injuries revealed signs of CTE in 65 of 85 donor brains. Symptoms of CTE start with headaches and problems with concentration in the early stages, followed by depression, aggression, explosive anger and short-term memory loss. More serious cognitive impairments occur later, and eventually result in full-blown dementia.

In sports such as American football, hockey, and men's lacrosse, hard helmets are used to reduce the impact of collisions. However, in other sports such as soccer, women's lacrosse, rugby, and volleyball, where hard helmets are not worn, or are rarely worn, options for protecting against head-to-head collision, repeat ball-to-head impact, and collision with the ground or goal posts, are still limited.

SUMMARY OF THE INVENTION

The present disclosure is directed to a head guard assembly that can reduce the force of impact from a collision, in a way that reduces both linear acceleration and angular acceleration experienced by the head. By reducing both angular and linear acceleration, the head guard helps reduce the risk of concussion from a traumatic head impact.

A non-rigid head guard assembly, constructed in accordance with the invention provides superior protection against head collisions. The head guard is circular with a narrower section at the forehead and a wider section at the rear to protect the back of the head. The head guard, at the sections in contact with the temple area of the head and the back of the head, is reinforced with an additional layer of foam. The exterior of the assembly is made of breathable and moisture wicking fabric. The interior protective element consists of either a single layer of viscoelastic polyurethane foam or a dual layer viscoelastic polyurethane foam separated by a thin layer of semi-dry lubricant, which is a low friction material, for enhanced wear and corrosion protection. The purpose of the separation is to enable concentric rotation between the two layers. The purpose of such a rotational system is to deflect the force of the impact away from the direction of the impact. The foam and the exterior fabric assembly are attached together via sewing and breathable hot-melt film or other adhesives to fix fabric to foam. The polyurethane foam is optimized to provide a consistent impact absorption property at various temperature ranges of soccer playing conditions, both indoor and outdoor, and throughout the year.

DETAILED DESCRIPTION OF THE INVENTION

Figure 1:
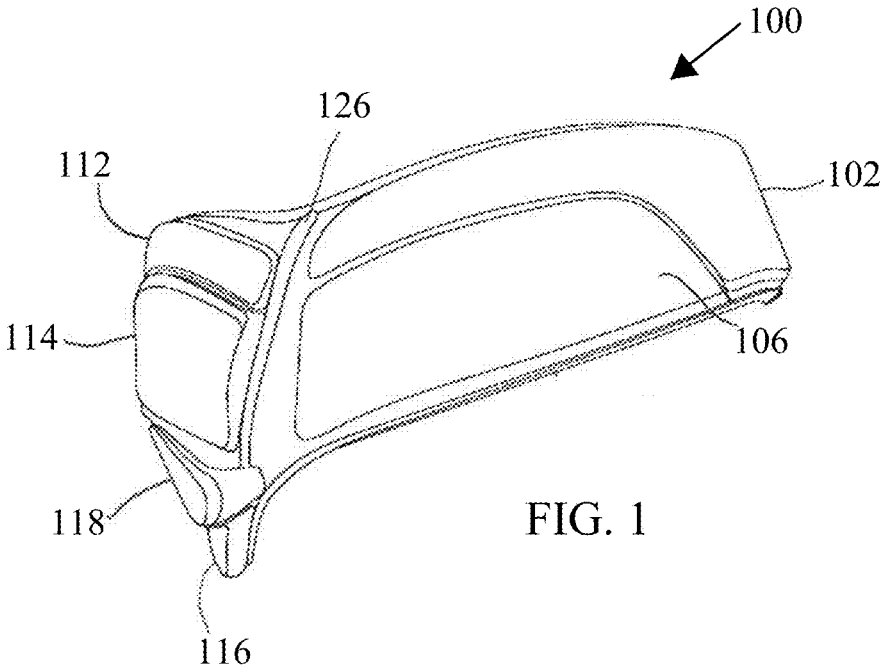
FIG. 1 is a right side perspective view of an embodiment of the head guard assembly of the present invention.
Figure 2:
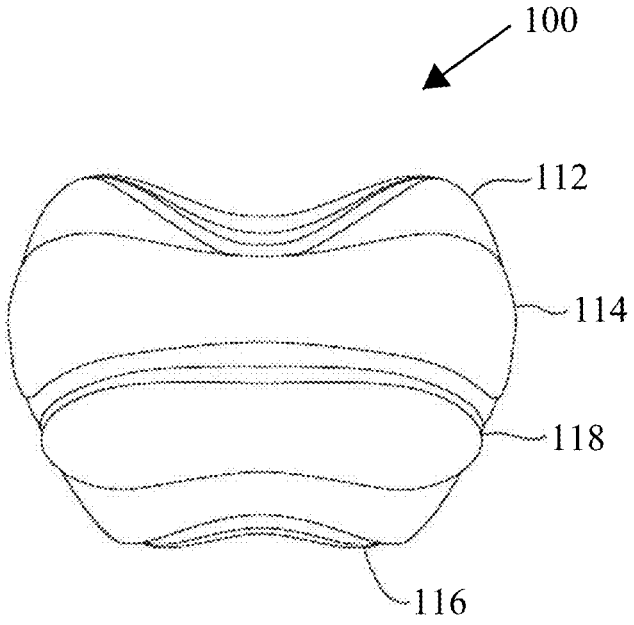
FIG. 2 is a rear perspective view thereof.
Figure 3:
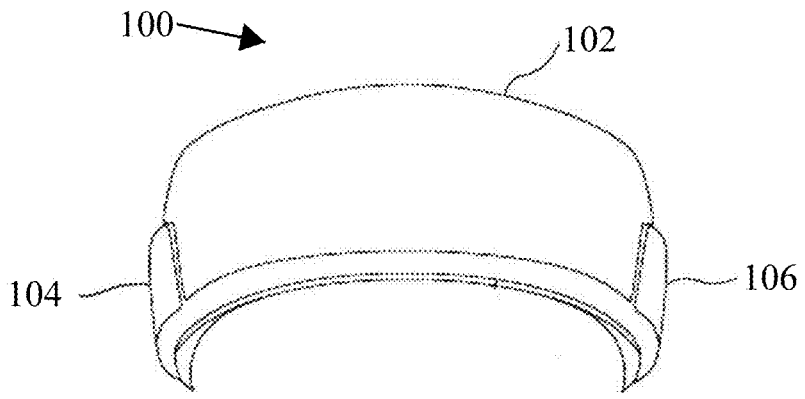
FIG. 3 is a front perspective view thereof.
Figure 4:
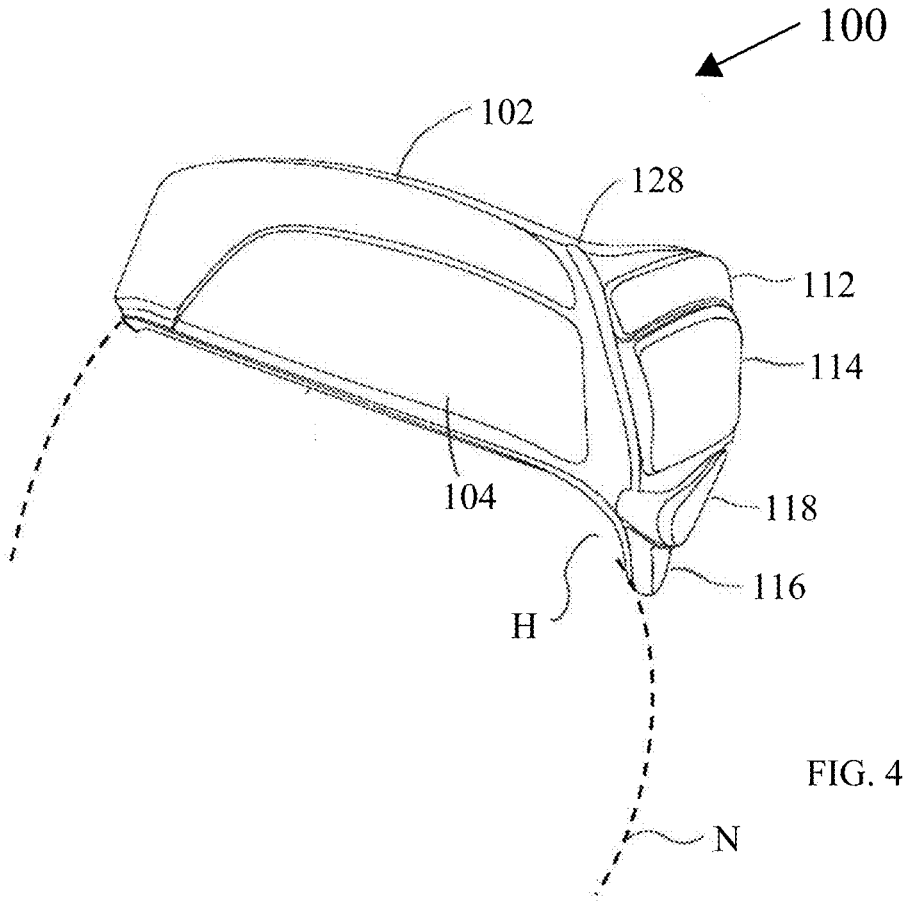
FIG. 4 is a left side perspective view thereof.
Figure 5C:
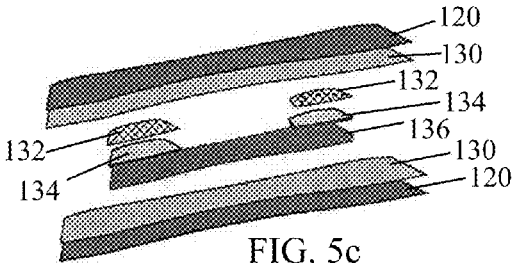
FIG. 5*c* is an exploded perspective view showing layers of the dual layer foam composition.
Figure 5D:
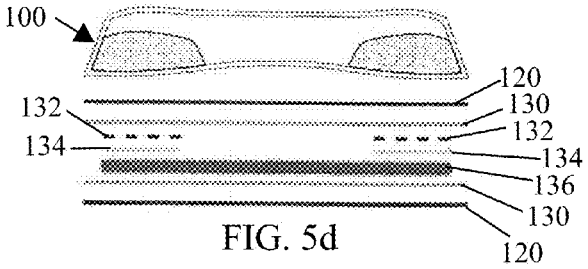
FIG. 5*d* is a front view of the dual layer foam composition.
Figure 5A:
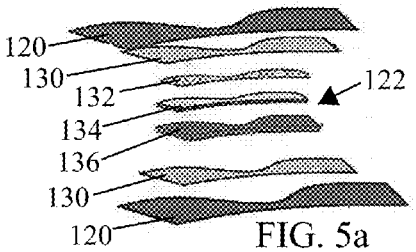
FIG. 5*a* is an exploded front view of an embodiment of a dual layer foam composition of the head guard assembly of FIG. 1.
Figure 5E:
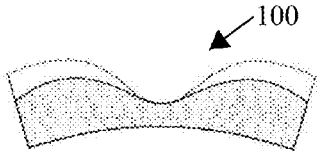
FIG. 5*e* is a top view of the dual layer foam composition incorporated in an embodiment into the head guard assembly of the present invention.
Figure 5B:
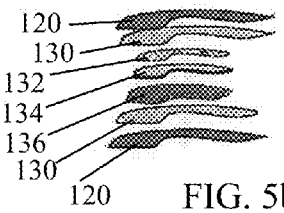
FIG. 5*b* is an exploded rear view of the dual layer foam composition of the head guard assembly of FIG. 1.
Figure 5F:
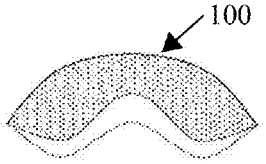
FIG. 5*f* is a bottom view of the dual layer foam composition incorporated in an embodiment into the head guard assembly of the present invention.

With reference to FIGS. 1 through 6, there is shown an embodiment of a head guard assembly of the present invention, which will be designated hereinafter as reference numeral 100, and embodiments of features of the head guard assembly 100. The head guard assembly 100 is of a circular construction in the shape of a ring and may wrap around a user's head, similar to a headband. The front 101 of the head guard assembly 100 is tapered, covering just the forehead. Included on the front 101 of the head guard assembly 100 are a front pad 102, a left temple pad 104, and a right temple pad 106. The front pad 102 extends around slightly more than half of the circumference of the head guard assembly 100 and includes creased junctions 126, 128 at opposite ends. The right temple pad 106 and the left temple pad 104 are positioned adjacent to the respective junctions 126, 128 and extend from the bottom of the head guard assembly 100 partially towards the top of the head guard assembly 100. The right temple pad 106 and the left temple pad 104 may further include an additional layer of foam to provide additional protection to the temple area like the foam assembly 122 for elements of the rear 110 of the head guard 100 that will be described below.

Figure 6A:
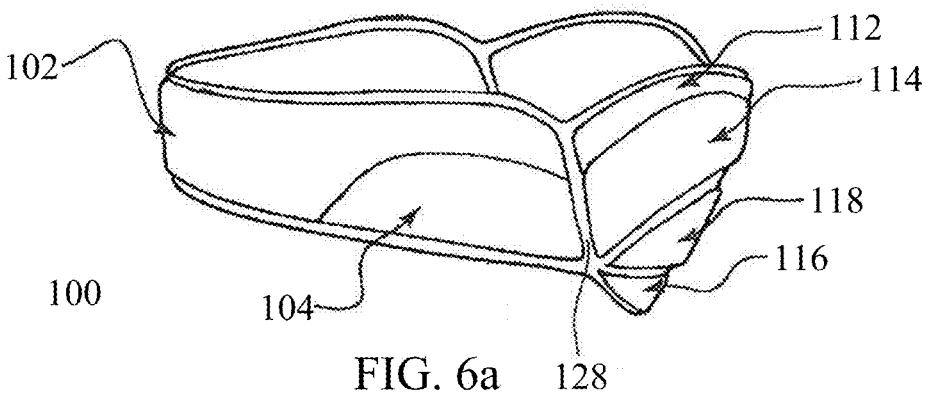
FIG. 6*a* is another left side perspective view of the head guard assembly of the present invention.
Figure 6B:
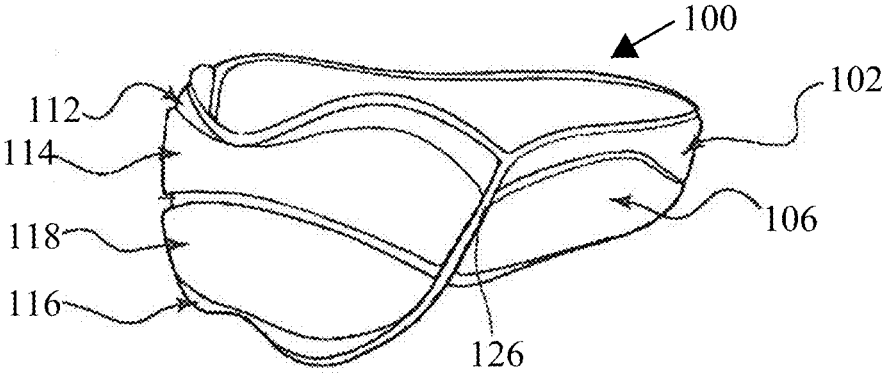
FIG. 6*b* is another right side perspective view of the heard guard assembly of the present invention.

The rear 110 of the head guard assembly 100 covers a wider area, including the back of the head H of the wearer of the head guard assembly 100 and the top of the neck N to provide comprehensive protection against head-to-head collisions as well as collisions with the ground. As illustrated in FIGS. 6*a* and 6*b*, the rear 110 of the head guard assembly 100 includes a main upper pad 112, a second upper pad 114, a main lower pad 116, and a second lower pad 118. The second upper pad 114 extends from the junction 126 around the rear 110 of the head guard assembly 100 to the opposing junction 128. The second upper pad 114 and the second lower pad 118 are reinforced with an additional layer of foam forming a foam assembly 122, similar to the temple pads 104, 106.

The foam assembly 122 as shown in FIGS. 5*a*-5*f* includes a main foam layer 136 that is arranged adjacent to a first side of top foam layers 134.

The preferred fabric of the heard guard, which encompasses the entire head guard assembly 100, is a woven breathable fabric 120 made of synthetic fibers. To secure the elements of the front 101 and rear 110 of the head guard assembly 100 that can include single layers of foam and multiple layers of foam (i.e., the foam assembly 122) between layers of the breathable fabric 120, the fabric 120 wraps around the single layers of foam (e.g., the front pad 102, the main upper pad 112, the main lower pad 116) and the multiple layers of foam that are part of the foam assembly 122 (i.e., the temple pads 104, 106, the second upper pad 114 and the second lower pad 118), and the layers of the fabric 120 are stitched together. In an embodiment, and thermoplastic polyurethane film or other adhesives 130 aid to fix the layers of fabric 120 to foam by gluing the foam to the layers of fabric 120 using a heat press (i.e., hot melting). Additional webbing material (i.e., mesh layers 132) may be added for decorative purposes. As shown in FIGS. 5*a*, 5*b*, 5*c* and 5*d*, the mesh layers 132 can be added as well between the layers of fabric 120.

The foam 102, 104, 106, 112, 114, 116, 118 used in the head guard assembly 100 has been optimized to provide consistent impact protection at a wide temperature range that simulates extreme soccer playing conditions throughout the year. For testing, the American Society for Testing and Materials (ASTM) F2439 "Specification For Headgear used in Soccer" was used to measure impact absorption of the head guard at room temperature (22° C.), high temperature (50° C.), and low temperature (−14° C.).

The foam of the head guard assembly 100 is viscoelastic foam. The viscoelastic foam deforms when a force is applied thereto. The amount of deformation is dependent on three factors: (1) the amount of force applied; (2) the duration of the application of the force; and (3) the temperature of the environment of the foam.

Viscoelasticity arises from the formation and breaking of non-covalent bonds in the underlying material, the time-dependent strain either increases or decreases with temperature. This poses a challenge creating viscoelastic foam that acts consistently across a wide temperature range. At high temperature, as non-covalent bonds are broken, the time-dependent strain property is decreased. This results in softening of the material, and thus decreasing protection against impact. At low temperatures, more non-covalent bonds are formed, thus increasing the time-dependent strain property. This results in the stiffening or hardening of the material, which can also decrease impact protection, as the cushioning property of the material is lost. Additionally, the material can become so stiff that it could not be worn on the head.

The head guard assembly 100 incorporates viscoelastic foam that exhibits consistent impact absorption properties, and is pliable enough to form around one's head, at the three temperatures mentioned above.

On impact absorption, the optimized foam will absorb at least 30% of the impact force (as outlined in the ASTM testing standard) at all three temperatures. The consistent level of impact absorption allows the same head guard assembly 100 to be used both in the summer and the winter.

One factor providing this property is tuning the glass-transition temperature (i.e., the temperature in which the molecules changes between solid and liquid state) of the foam to be higher than the human body temperature, i.e., above 40° C. This allows the foam to remain at the uniform solid state below 40° C. The result of this higher glass transition temperature is to give the foam a more constant time-dependent strain rate below the transition temperature. By tweaking the foam density, the glass transition temperature, and the cure rate, an optimized foam for the head guard assembly 100 is achieved.

Optionally, a layer of low friction material such as TEFLON® (i.e., a polymer with slippery, nonstick properties) or another type of lubricant may be placed between the top foam layers 134 and the main foam layer 136 comprising the foam assembly 122. This would allow for concentric rotation of the two foam layers 134, 136. The purpose of this mechanism is to deflect the impact force vector away from the direction of the original impact. This allows an additional source of impact dissipation. More importantly, by allowing the foam layers 134, 136 to rotate against each other, the angular acceleration experienced by the head of the user may be reduced. Scientific studies have suggested that angular acceleration of the head is linked to concussions. Thus, reducing angular rotation may reduce the risk of concussions in users of the heard guard assembly 100. Additionally, the low-friction material layer is perforated to facilitate breathability, cooling and sweating, which allows for improved temperature management.

For the rear 110 and sides of the head guard assembly 100, there is also a third external-facing foam to provide additional protection.

The accompanying drawings only illustrate several embodiments of a heard guard and its respective constituent parts, however, other types and styles are possible, and the drawings are not intended to be limiting in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A head guard assembly, comprising:

a body having an opening therein that is delimited at an upper outer periphery and a lower outer periphery, the body including a front section and a rear section that are connected to each other at a first junction and at a section junction, the front section comprising a front pad, a left temple pad and a right temple pad and the rear section comprising a main upper pad arranged adjacent to the upper outer periphery of the body, a second upper pad arranged adjacent to the main upper pad and spaced away from the lower outer periphery, a main lower pad arranged adjacent to the lower outer periphery of the body and a second lower pad arranged between the main lower pad the second upper pad that is spaced away from the upper outer periphery and the lower outer periphery of the body, wherein the front body, the right temple pad and, the left temple pad are independent elements of each, wherein at least the main upper pad extends about the rear section and is delimited between the first junction and the section junction, and wherein the front section has a narrower width between the upper outer periphery and the lower outer periphery of the body than the rear section.

2. The head guard assembly in claim 1, wherein the front section of the head guard is tapered towards the rear section of the head guard with the front section configured to cover only a user's forehead.

3. The head guard assembly in claim 1, wherein the front pad extends more than half of a circumference of the head guard.

4. The head guard assembly in claim 1, wherein the right temple pad and the left temple pad are positioned adjacent to the first junction and the second junction, respectively, and extend from the lower outer periphery of the body towards the top with a portion of the front pad extending between the right temple pad and the left temple pad and the upper outer periphery of the body.

5. The head guard assembly in claim 1, wherein the right temple pad, the left temple pad, the second upper pad and the second lower pad are constructed of a first layer and a second layer of polyurethane foam.

6. The head guard assembly in claim 5, further including a low-friction layer arranged between the first layer and the second layer of polyurethane foam comprising the right temple pad, the left temple pad, the second upper pad and the second lower pad, facilitating concentric rotation of the first layer of polyurethane foam and the second layer of polyurethane foam to deflect an impact force vector away from a direction of original impact.

7. The head guard assembly in claim 1, wherein the front pad, the right temple pad, the left temple pad, the main upper pad, the second upper pad, the second lower pad and the main lower pad are each constructed of perforated foam to allow breathability and temperature management.

8. The head guard assembly in claim 1, wherein the front pad, the right temple pad, the left temple pad, the main upper pad, the second upper pad, the second lower pad and the main lower pad are comprised of a foam that will absorb at least 30% of an impact force at any temperature.

9. The head guard assembly in claim 1, wherein the right temple pad and the left temple pad are each comprised of a first layer of foam and a second layer of foam to provide protection to the temple area.

10. The head guard assembly in claim 1, wherein the second upper pad and the second lower pad include a first layer of foam and a second layer of foam.

11. The head guard assembly in claim 6, wherein the layer of low friction material is a fluorocarbon polymer with nonstick properties that is placed between the first layer of polyurethane foam and the second layer of polyurethane foam.

12. A head guard assembly, comprising:

a body including an opening therein that is delimited at an upper outer periphery and a lower outer periphery, the body comprising a front section that includes a front pad, a right temple pad arranged adjacent the front pad on a right side of the front pad and a left temple pad spaced from the right temple pad and arranged adjacent the front pad on a left side of the front pad and a rear section comprising a main upper pad including a first side and a second side, arranged adjacent to the upper outer periphery, a second upper pad including a first side and a second side, arranged adjacent at the first side of the second upper pad to the second side of the main upper pad, a second lower pad including a first side and a second side, arranged adjacent at the first side of the second lower pad to the second side of the second upper pad and a main lower pad including a first side and a second side arranged adjacent to the second side of the second lower pad, at least one of the pads of the front section and the rear section being comprised of a single layer of foam material and at least one of the pads of the front section and the rear section being comprised of a foam assembly, including a first layer and a second layer of foam material.

13. The head guard assembly of claim 12, wherein the single layer of foam and the foam assembly are comprised of viscoelastic foam.

14. The head guard assembly of claim 12, wherein the front pad, the main upper pad and the main lower pad are comprised of the single layer of foam material.

15. The head guard assembly of claim 12, wherein the right temple pad, the left temple pad, the second upper pad and the second lower pad are comprised of the two layers of foam material.

16. The head guard assembly of claim 12, further comprising a layer low friction material that is a fluorocarbon polymer with nonstick properties arranged between the first layer of foam material and the second layer of foam material.

17. The head guard assembly of claim 12, wherein a width of the front section and a width of the rear section are delimited between a first outer periphery and a second outer periphery and the width of the front section is narrower than the width of the rear section.

18. A head guard assembly of claim 12, wherein the body is enclosed within a layer of moisture wicking fabric.

19. The head guard assembly of claim 18, further comprising a layer of adhesive configured to bond the body to the layer of the moisture wicking fabric.

20. A head guard assembly, comprising:

a body including an opening therein that is delimited at an upper outer periphery and a lower outer periphery, the body comprising a front section that includes a front pad, a right temple pad and a left temple pad spaced from the right temple pad and a rear section comprising a main upper pad, a second upper pad, a second lower pad and a main lower pad that are each arranged between the upper outer periphery and the lower outer periphery, at least one of the pads of the front section and the rear section being comprised of a single layer of foam material and at least one of the pads of the front section and the rear section being comprised of a foam assembly, including a first layer and a second layer of foam material.

* * * * *